United States Patent [19]

Bell et al.

[11] 4,091,729

[45] May 30, 1978

[54] LOW VULNERABILITY BOOSTER CHARGE CASELESS AMMUNITION

[75] Inventors: Frank H. Bell, Brigham City; Ronald L. Borcherding, Tremonton; William O. Munson, Brigham City; Michael S. McDonald, Mantua; John A. Peterson, Brigham City, all of Utah

[73] Assignee: The United States of America as represented by the Secretary of the Army, Washington, D.C.

[21] Appl. No.: 775,140

[22] Filed: Mar. 7, 1977

[51] Int. Cl.[2] ..... F42B 9/16; C06B 45/22

[52] U.S. Cl. ..... 102/38; 102/103; 102/DIG. 1; 149/11; 149/19.4; 149/92

[58] Field of Search ..... 102/38 R, 38 CC, DIG. 1, 102/103; 149/11, 19.4, 92

[56] References Cited

U.S. PATENT DOCUMENTS

| | | | |
|---|---|---|---|
| 3,645,207 | 2/1972 | Daniels | 102/DIG. 1 |
| 3,646,174 | 2/1972 | Macri | 149/44 X |
| 3,806,461 | 4/1974 | Hendrickson et al. | 149/19.4 X |
| 3,834,957 | 9/1974 | McDevitt et al. | 149/92 X |
| 3,847,081 | 11/1974 | Quinlan et al. | 102/38 |
| 3,884,735 | 5/1975 | Cramer | 149/11 |
| 3,888,707 | 6/1975 | Rothenstein | 149/19.4 |
| 3,909,322 | 9/1975 | Chang et al. | 149/19.4 |
| 3,948,697 | 4/1976 | Flanagan et al. | 102/103 X |

FOREIGN PATENT DOCUMENTS

| | | | |
|---|---|---|---|
| 7,193 of | 1891 | United Kingdom | 102/DIG. 1 |

*Primary Examiner*—Edward A. Miller

*Attorney, Agent, or Firm*—Nathan Edelberg; Harold H. Card, Jr.; A. Victor Erkkila

[57] ABSTRACT

A low vulnerability booster charge comprising single, fairly large crystals of 1,3,5,7-tetramethylenetetranitramine (HMX) or 1,3,5,-trimethylenetrinitramine (RDX) about 160 microns diameter coated with a polyurethane cement which comprises about 15 weight percent of the entire booster charge.

12 Claims, 1 Drawing Figure

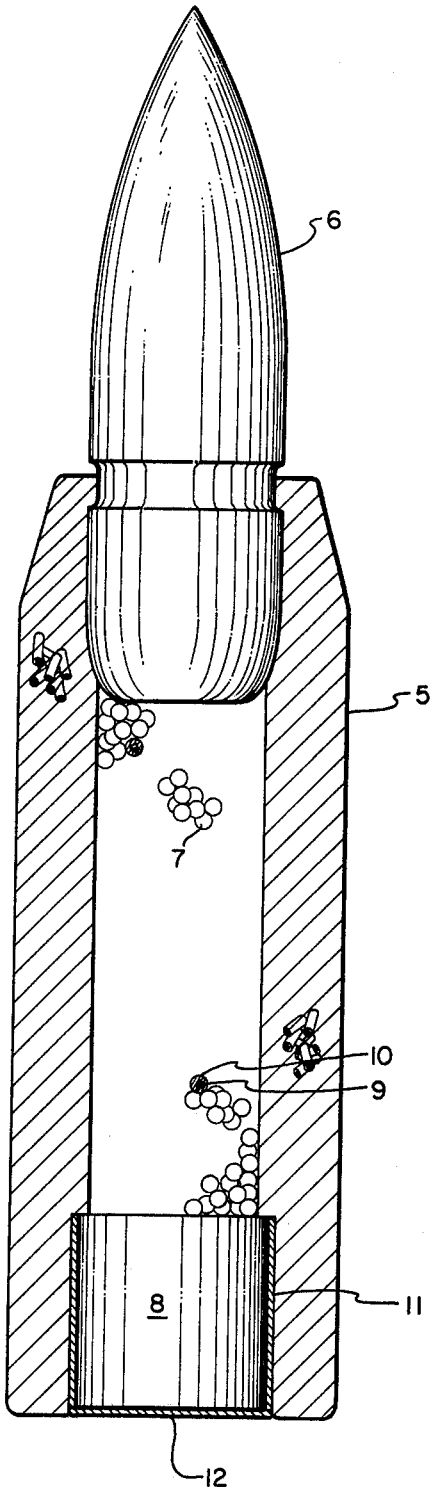
6
5
7
10
9
8
11
12

LOW VULNERABILITY BOOSTER CHARGE CASELESS AMMUNITION

The invention described herein may be manufactured, used and licensed by or for the Government for governmental purposes without the payment to us of any royalty thereon, and was made in the course of or under a contract with the U.S. Department of the Army.

STATEMENT OF THE INVENTION

This invention relates to ammunition and more particularly concerns a low vulnerability booster charge propellant wherein crystals thereof are coated with polyurethane.

BACKGROUND OF THE INVENTION

A continuing objective in the design of ammunition, particularly for military use, is to provide ammunition that is energetic when used, but which presents very low hazard and low vulnerability to heat, flame, impact, friction, and chemical action. This is especially important in confined quarters, such as in tanks, or submarines.

Propellants having these properties, however, are usually difficult to ignite, and require a booster propellant that is usually contained in a small cavity in the main propellant charge adjacent the primer cap. This provides a certain amount of protection for the booster charge, which is more easily ignitable than the main propellant charge; and, hence, is necessarily somewhat more vulnerable to accidental ignition by heat, impact, abrasion, etc. However, performance of conventional booster charges is still somewhat unsatisfactory in this respect. For example, the commonly-used, nitrocellulose booster charge autoignites at about 356° F (180° C) and is quite sensitive to shock and abrasion.

SUMMARY OF THE INVENTION

The present invention, which overcomes these disadvantages of the prior art ammunition, is an unique, particulate booster charge contained within the space between the projectile and primer of a caseless cartridge, for example, having a tubular main propellant charge with a projectile bonded into one end and a primer cap bonded into the other end. The booster charge comprises fairly large crystals (about 160 micron weight mean diameter) of 1,3,5,7-tetramethylenetetranitramine (HMX) or 1,3,5-trimethylenetrinitramine (RDX), or combinations thereof in any proportions, each coated with a polyurethane cement that comprises about 15% of the total weight of the booster charge. The crystals become coated by being stirred and tumbled in the liquified cement mixture at elevated temperatures. The booster charge compositions of the present invention are useable with all caliber ammunition notwithstanding the invention disclosed herein is described in conjunction with a small arms caseless cartridge.

The polyurethane cement simultaneously performs the triple function of inhibitor, insulation, and fuel. As inhibitor, it provides a means for insuring that the explosive crystals of HMX and RDX will burn slowly rather than fastburn or detonate; and the rate of burning may be precisely controlled by regulating the thickness of the polyurethane on the crystals. As an insulation, the polyurethane coating protects the explosive crystals from shock, abrasion, flame, and chemical action. This provides a booster propellant having a very high energy density, but that is fairly insensitive to these events. As a fuel, the polyurethane cement contributes to the total impulse or volume of gas that propels the projectile.

Objects of the invention are to provide caseless gun ammunition that is relatively insensitive to shock, heat, friction, impact, and chemical action; and to provide a booster charge for cartridges that is of low vulnerability yet highly energetic when ignited, so that the cartridges are reliable and effective.

Other objects and advantages of the invention will become apparent as the following detailed description is read with reference to the accompanying drawing.

BRIEF DESCRIPTION OF THE DRAWING

In the drawing:

The FIGURE is a longitudinal section of the invention.

DESCRIPTION OF THE PREFERRED EMBODIMENT

A preferred formulation for the main propellant charge is, in parts by weight:

| | |
|---|---|
| 1,3,5,7-tetramethylenetetranitramine (HMX) ($C_4H_8N_8O_8$) very fine, particulate | 75.00 |
| Hydroxyl-terminated block copolymer of propylene oxide and ethylene oxide | 11.867 |
| Trimethylolpropane | 3.167 |
| Lysine diisocyanate methyl ester | 9.967 |
| Titanyl acetyl acetonate | 0.025 |

All of the HMX is included in the composition as crystals having weight mean diameters of about 2 microns. This propellant is typically extruded and placed in a curing oven in the form of small-diameter tubes. When cured or partially cured, it is chopped into short lengths and pressed in a mold to form a dense hollow, cylindrical mass 5, as shown in the FIGURE.

A conventional projectile 6 is then bonded into one end of this charge 5; the center of the main charge 5 is filled with the particulate booster charge 7; and a conventional caseless primer cap 8 is bonded into the end of the main charge 5 opposite the projectile 6 with a glue 11 and sealed therein with a seal disk 12.

The booster charge consists essentially of single, large crystals 9 of the HMX or RDX or combinations thereof in any proportion, each of the crystals being coated with a polyurethane cement 10 having the formulation and weight percentages as shown in Table I below:

TABLE I

| Constituents | Polyurethane Cement Range, wt. % | Preferred wt. % |
|---|---|---|
| Diisocyanate bitolylene (Isonate 136T) | 30–55 | 37.58 |
| Hydroxyl-terminated polyethylene oxide (Carbowax C-4000) | 40–65 | 52.52 |
| Trimethylol propane (TMP) | 5–15 | 9.80 |

The booster charge 7 is made by mixing the above ingredients thoroughly and then blending in a methylene chloride solvent in sufficient quantity to form a slurry. The crystals 9 of HMX or RDX are added to the slurry and stirred. Preferably the mixture is then placed in an evaporator from which the air is evacuated and is subjected to prolonged tumbling at elevated temperatures, during which the explosive crystals are uniformly coated with the cured polyurethane composition. This heat treatment is preferably 200° F for about 120 minutes. However, lower heat may be used for longer time periods. The polyurethane coating 10 is preferably thick enough to comprise about 15% by weight of the total composition.

Isonate 136T is a product of Upjohn Co., Polymer Chemical Division, La Porte, Texas, and is a diisocyanate bitolylene having a melting point of 69°–71° C, also known as bitolylene diisocyanate, or 3,3'-dimethyl-4,4'-biphenylene diisocyanate.

Carbowax C-4000 is a product of Union Carbide & Carbon Chemical Co., New York, and is a hydroxyl-terminated polyethylene oxide having a specific gravity of 1.2, a freezing range between 50°–55° C, a flash point greater than 475° F, and a Saybolt viscosity at 210° F between 500 and 700 seconds.

EXAMPLE I

About 1.48 grams of TMP powder, 7.88 grams of hyroxyl-terminated polyethylene oxide powder (Carbowax C-400), and 5.64 grams of diisocyanate bitolylene powder (Isonate 136T) were thoroughly mixed and dissolved in about 100 ml of methylene chloride and poured into a 500 ml flask. About 85 gm of HMX crystals, having a weight mean diameter of about 160 microns, was added and the mixture was stirred thoroughly. The composition was then placed in a rotating, evacuated evaporator, heated to 100° F, and was left to rotate overnight resulting in an agglomerate-free granular composition, wherein each crystal of HMX was uniformly coated with the polyurethane binder.

The resulting booster propellant 7 has been found to be superior to propellants that incorporate the explosive oxidizer in the form of very finely divided particles in that it is much less sensitive to solvents, impact, and abrasion. Also, its burning rate can be controlled with considerable precision simply by varying the thickness of the coating 10 of each crystal 9.

The booster propellant 7 of the present invention (labled "Booster I") was found to have the following properties in comparison to those of a widely used, single base, nitrocellulose gun propellant (labeled "Booster R"):

TABLE II

Thermal Stability & Ignition Values of Propellants

| Thermal Stability | Booster I | Booster R |
|---|---|---|
| Autoignition time (550° F) (sec) | 18.5 | 2.6 |
| Autoignition time (450° F) (sec) | >200 | 7.2 |
| Differential thermal analysis (° F) | 480 | 370 |
| Flashpoint (° F) | 518 | 356 |
| Explosion temperature test (5 sec) (° F) | 664 | 469 |
| Cookoff time (550° F) (sec) | > 20 | 8 |
| | no case | brass case |
| Ignition Tests | | |
| Laser beam time (sec) | no ignition | 2–5 |

The above tests indicate the clearly superior thermal stability properties of Booster I over Booster R. Similarly, the sensitivity to radiation of our propellant over the nitrocellulose propellant is shown by the laser beam ingition test. No test parameters are provided since both propellants were subjected to identical testing procedures and, as abovementioned, only a broad comparison between the two propellants was desired.

The range of constituents comprising our polyurethane cement must be closely adhered to. For example, if the C-4000 content of the cement falls below about 40 wt.%, the cement becomes brittle. Conversely, above about 65 wt.%, an unduly soft product results. When the TMP weight percent drops below about 5, a soft cement results; whereas a hard, brittle product will be formed when the weight percent exceeds about 15. Isonate 136T in amounts below or above the designated range yields an excessively soft product. The equivalent formula for our polyurethane coating has been calculated thus: $C_{5.04}H_{7.68}N_{0.25}O_{1.76}$ HMX and RDX have been found to be interchangeable in our booster charge in any proportions, the total preferably being about 85 wt.%, although a range of between about 82 to 88 wt.% is satisfactory. Amounts exceeding about 88 wt.% have been shown to provide a propellant too readily detonable. Overall performance suffers, on the other hand, when the amount of HMX or RDX falls below about 82 wt.%. RDX produces a slightly greater burning rate, but this is negligible and does not affect the parameters of the composition.

In addition to providing a low-vulnerability booster propellant, this new propellant obtains higher temperatures and pressures than were attained by previous booster charges.

It is apparent from the foregoing description that we have provided a reliable and effective low vulnerability ammunition propellant usable with all caliber weapons and wherein it is desired that the propellant be highly energetic after being ignited, and yet relatively insensitive to shock, heat, friction, impact, and chemical action.

We do not wish the invention to be limited to the exact details herein shown for obvious modifications will occur to one skilled in the art.

We claim:

1. In a gun ammunition cartridge including a cylindrical, caseless propellant charge, a projectile bonded into one end thereof, and a primer cap bonded into the other end, a cavity being provided in the propellant charge adjacent the primer cap, the improvement comprising:

a particulate booster charge in the cavity wherein each particle comprises a single crystal ranging from 100 to 500 micron weight mean diameter selected from the group consisting of 1,3,5,7-tetramethylenetetranitramine and 1,3,5-trimethylenetrinitramine and a cured polyurethane coating on each crystal comprising about 30 to 55 weight % diisocyanate bitolylene, about 40 to 65 weight % hydroxyl-terminated polyethylene oxide, and about 5 to 15 weight % trimethylol propane.

2. The cartridge of claim 1 wherein the crystals of the booster charge are 1,3,5,7-tetramethylenetetranitramine.

3. The cartridge of claim 1 wherein the crystals of the booster charge are 1,3,5-trimethylenetrinitramine.

4. The cartridge of claim 1 wherein the polyurethane coating comprises about 15% by weight of the particulate booster charge.

5. The cartridge of claim 1 wherein the crystals of the booster charge are any proportions of 1,3,5,7-tetramethylenetetranitramine and 1,3,5-trimethylenetrinitramine.

6. The cartridge of claim 1 wherein said polyurethane coating comprises 37.58 weight % diisocyanate bitrolylene, 52.52 weight % hydroxyl-terminated polyethylene oxide and 9.80 weight % trimethylol propane.

7. A particulate, low-vulnerability, booster propellant for gun ammunition wherein each particle comprises:

a single crystal ranging from 100 to 500 micron weight mean diameter selected from the group consisting of 1,3,5,7-tetranethylenetetranitramine and 1,3,5-trimethylenetrinitramine; and a cured polyurethane coat on each said crystal comprising about 30 to 55 weight % diisocyanate bitolylene, about 40 to 65 weight % hydroxylterminated polyethylene oxide, and about 5 to 15 weight % trimethylol propane.

8. The booster of claim 7 wherein the crystals thereof are 1,3,5,7-tetranethylenetetranitramine.

9. The booster of claim 7 wherein the crystals thereof are 1,3,5-trimethylenetrinitramine.

10. The booster of claim 7 wherein said polyurethane coating comprises about 15% by weight of the particulate booster charge.

11. The booster of claim 7 wherein the crystals thereof are any proportions of 1,3,5,7-tetramethylenetetranitramine and 1,3,5-trimethylenetrinitramine.

12. The booster propellant as described in claim 7 having thermal stability and ignition values as presented in Table II of the specification.

* * * * *